United States Patent [19]

Kajiyama

[11] Patent Number: 4,719,994

[45] Date of Patent: Jan. 19, 1988

[54] FLOOR RE-LEVELING APPARATUS FOR ELEVATOR

[75] Inventor: Ryuichi Kajiyama, Hoji Heights, Japan

[73] Assignee: Mitsubishi Denki Kabushiki Kaisha, Japan

[21] Appl. No.: 801,312

[22] Filed: Nov. 25, 1985

[30] Foreign Application Priority Data

Nov. 27, 1984 [JP] Japan ..... 59-250062

[51] Int. Cl.[4] ..... B66B 1/40

[52] U.S. Cl. ..... 187/113

[58] Field of Search ..... 187/29 R, 113; 318/611

[56] References Cited

U.S. PATENT DOCUMENTS 4,337,846 7/1982 Yonemoto et al. ..... 187/29 R

FOREIGN PATENT DOCUMENTS 52-131341 11/1977 Japan .

*Primary Examiner*—William M. Shoop, Jr.
*Assistant Examiner*—Richard K. Blum
*Attorney, Agent, or Firm*—Leydig, Voit & Mayer

[57] ABSTRACT

Floor re-leveling apparatus including a microprocessor; cage position detectors produce outputs representative of the position of the cage in any one of three sections, a normal floor arrival section, one other section immediately above the normal floor arrival section, and one other section immediately below the normal floor arrival section. A speed reference signal having a preferred characteristic is generated and an actual cage speed signal is compared with the reference signal.

3 Claims, 14 Drawing Figures

FLOOR RE-LEVELING APPARATUS FOR ELEVATOR

BACKGROUND OF THE INVENTION

This invention relates to improvements in a re-leveling apparatus for an elevator which serves to reposition an elevator cage to re-level the floor of the cage of the elevator when the cage has stopped outside normal floor arrival limits.

In an A.C. elevator, it is sometimes the case that, when a cage stops at a destination floor, the fault of a floor arrival control device or the fluctuation of the characteristic thereof causes the levels of a hall floor and a cage floor to deviate greatly, making it difficult to get on and off the cage. In such a case, the cage floor needs to be brought close to the hall floor as quickly as possible. That is, the operation of automatically repositioning the cage to level the cage floor with the hall floor is carried out. Hereinbelow, this operation shall be termed the 'floor re-leveling operation'.

An example of such a floor re-leveling apparatus has hitherto been proposed in Japanese Patent Application Laid-open No. 52-131341.

FIGS. 12 through 14 show the prior-art floor re-leveling apparatus mentioned above. Referring to the figures, letters R, S and T designate a three-phase A-C power sources, and symbols (+) and (−) denote an D-C power source. Numeral 21 indicates an electromagnetic contactor for an up run, which has normally-open contacts 2*la*–2*lc*. Numeral 22 indicates an electromagnetic contactor for a down run, which has normally-open contacts 22*a*–22*c*. Symbol 23A denotes an ordinary run control device, while symbol 23B denotes a floor arrival control device for controlling the speed of a cage 31 in a floor arrival mode. Shown at numeral 24 is a driving induction motor. A braked wheel 25 is driven by the motor 24, a brake shoe 26 exerts a frictional force on the braked wheel 25, and a brake coil 27 releases the brake shoe 26 from the brake wheel 25 against the force of a spring 28 when energized. The spring 28 presses the brake shoe 26 against the brake wheel 25 owing to the force of the spring 28 when the coil 27 is deenergized. The aforementioned brake wheel 25, brake shoe 26, brake coil 27 and spring 28 form a magnet brake. Numeral 20 designates the sheave of a hoist, and numeral 30 a main rope which is wound round the sheave 20 and to which the cage 31 and a counterweight 32 are coupled. Numeral 33 designates a floor in a hall of a building. Symbols U1a, U1b, U2a and U2b denote up position switches which operate according to the positions of the cage 31, respectively, and which are realized by, for example, installing position switches (not shown) in the cage 31 and cams (not shown) in a hoistway. The operating states of the position switches are shown in FIG. 14, in which hatched parts indicate the 'off' sections thereof. Symbols D1a, D1b, D2a and D2b denote down position switches which operate similarly. A floor re-leveling relay 35 has normally-open contacts 35*a* and 35*b*, and a normally-closed contact 35*c*. A floor re-leveling electromagnetic contactor 36 has a normally-open contact 36*a*, which is associated with a starting resistor 37. Numeral 38 indicates a reset type time-limit relay having a normally-open contact 38*a*, and numeral 39 also indicates a reset type time-limit relay having a normally-open contact 39*a*.

Next, the operation of this example will be described.

In a case where the cage 31 performs the up run, the operation of the ordinary run control device 23A energizes the electromagnetic contactor for the up run 21 to close the contacts 2*la*. Since the floor re-leveling electromagnetic contactor 36 is held energized to close the contact 36*a*, the motor 24 is fed with electric power. At the same time, the contact 21*b* is also closed, the brake coil 27 is energized to release the magnet brake, and the motor 24 rotates, so that the cage 31 ascends through the sheave 20 as well as the main rope 30. When the cage 31 has reached the deceleration point of a destination floor, the floor arrival control device 23B operates, and the cage 31 stops upon coming near to the floor 33.

When the ordinary run has ended, the contactor 21 is deenergized to open the contacts 2*la*–2*lc*, and the motor 24 is cut off from the power source R, S, T. The brake coil 27 is also deenergized allowing the brake 26 to engage the brakewheel 25 thereby holding the cage 31 at a stationary position. Assuming here that the stop position of the cage be a point a in FIG. 14, the position switches D2a, D2b, D1a and D1b are turned 'on'. Soon after the opening of the contact 2*lc*, the time-limit relay 38 is reset to close the contact 38*a*, and the floor re-leveling relay 35 is energized by a closed circuit consisting of (+) - (38*a*) - (D2a) - (D1b) - (35) - (−), so that the contact 35*a* is closed. Thus, the contactor 21 is energized by a closed circuit consisting of (+) - (35*a*) - (D1a) - (21) - (−), and the contacts 2*la* - 2*lc* are closed, with the result that the motor 24 is fed with power. At the same time, the magnet brake is released, and the cage starts in the up direction. Meanwhile, since the energization of the floor re-leveling relay 35 opens the contact 35*c*, the contactor 36 is deenergized to open the contact 36*a*, whereby the starting resistor 37 is inserted in one phase of the motor 24 so as to make the acceleration of the cage in the floor re-leveling mode lower than that in the ordinary run mode.

Subsequently, when the cage 31 has reached a point P in FIG. 14, the position switches D2a and D2b are turned 'off', and the relay 35 is deenergized (the contact 39*a* of the time-limit relay 39 is kept open for a while after the turn-off of the switches D2a and D2b). Accordingly, the contact 35*a* opens, and the contactor 21 is deenergized to open the contacts 2*la*–2*lc*, so that the power feed to the motor 24 is cut off and that the magnet brake works. Assuming that the cage 31 has stopped at a point b on this occasion, only the position switches D1a and D1b are 'on'. Next, soon after the turn-off of the position switch D2b and the opening of the contact 2lc, the time-limit relays 38 and 39 are reset to close the respective contacts 38*a* and 39*a*, a closed circuit consisting of (+) - (38*a*) - (39*a*) - (D1b) - (35) - (−) energizes the relay 35 to close the contact 35*a* and turn on the switch D1a, and the contactor 21 is energized, so that the cage 31 is restarted in the same manner as in the start from the point a. Thereafter, when the cage 31 has come to a point Q in FIG. 14, the position switches D1a and D1b are also turned off, and the contactor 36 and the relay 35 are deenergized, whereupon the cage is decelerated in the same manner as in the deceleration from the point P. If, at this time, the cage 31 stops within normal floor arrival limits X, the floor re-leveling operation is completed.

In the prior-art floor re-leveling apapratus constructed as described above, the floor re-leveling operation is realized by the relay circuitry, so that the circuit arrangement becomes complicated and expensive. Another problem is that, when the cage stop position deviates greatly from the normal floor arrival limits, the floors cannot be leveled by the single floor leveling operation. A further problem is that, when the cage stops near the section of the normal floor arrival limits, the cage enters the section of the normal floor arrival limits before a sufficient increase in the speed thereof, so the floor arrival driving performance of the apparatus is inferior.

SUMMARY OF THE INVENTION

This invention has the objective to solve the above problems of the prior art, and has for its main object to provide a floor re-leveling apparatus for an elevator which permits floor re-leveling of high precision with a single operation by the use of an inexpensive and simple circuit arrangement and which can enhance the floor arrival driving performance.

The floor re-leveling apparatus for an elevator according to this invention comprises circuit means to compare a speed reference signal of a fixed level and the cage speed at all times and to generate a speed reference signal in time correspondence for controlling the speed so as to reduce the difference of the comparison.

In this invention, the cage speed is controlled using the speed reference signal in time correspondence from the circuit means to generate the speed reference signal, thereby to enable a floor re-leveling operation which provides a comfortable ride and high floor arrival precision even when a cage stop position deviates greatly from normal floor arrival limits.

BRIEF DESCRIPTION OF THE DRAWINGS

FIGS. 9 thru illustrate another embodiment of this invention, in which:

FIG. 9 is a characteristic diagram showing the relationship between the cage speed and the distance in a conventional technique at the time at which a cage has stopped in the vicinity of a normal floor arrival section;

In the drawings, the same symbols indicate identical or corresponding portions.

PREFERRED EMBODIMENTS OF THE INVENTION

Now, embodiments of this invention will be described with reference to the drawings.

Figure 1:
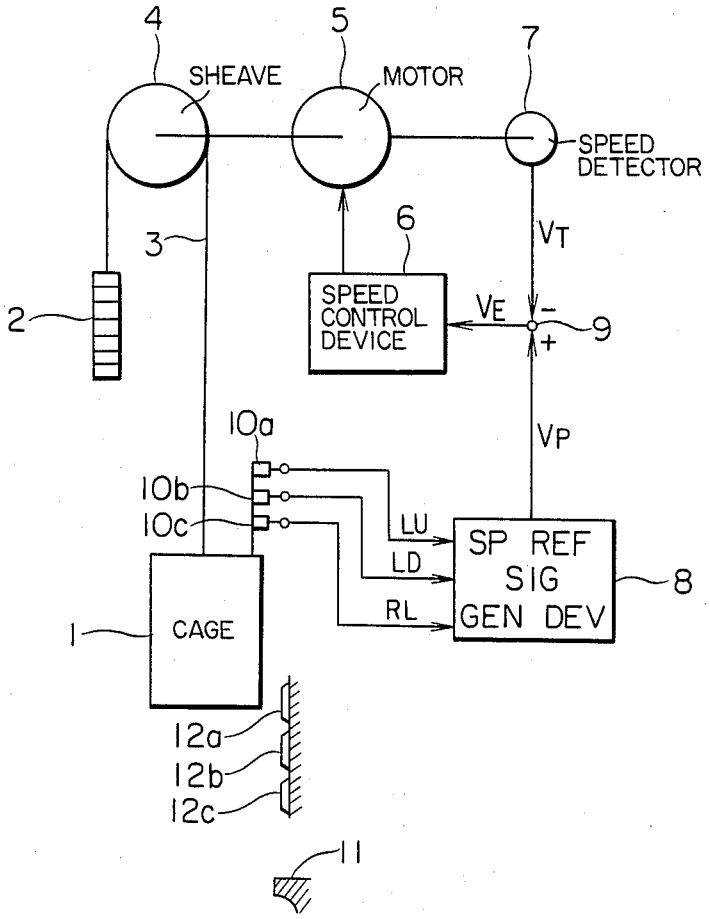
FIG. 1 is a circuit diagram showing an embodiment of a floor re-leveling apparatus according to this invention.

FIG. 1 shows a system structure diagram of a floor re-leveling apapratus for an elevator according to this invention. Numeral 1 designates a cage, and numeral 2 a counterweight. The cage 1 and the counterweight 2 are respectively coupled to the suspending ends of a main rope 3 which is wound round a sheave 4. Shown at numeral 5 is a motor which drives the sheave 4, and which is controlled by a speed control device 6. Numeral 7 indicates a speed detector which is directly coupled to the motor 5. An output signal $V_T$ from the speed detector 7 and a reference signal $V_P$ from a speed reference signal generating device 8 for floor re-leveling are input to a subtracter 9, and an error signal $V_E$ output from the subtracter 9 is input to the speed control device 6.

Symbols 10*a*–10*c* denote position detectors which are installed on the cage 1, and which deliver output signals LU, LD and RL respectively when they have come into engagement with position cams 12*a*–12*c* that are disposed in correspondence with each floor 11 of a building along a hoistway and near the level thereof. These output signals are input to the speed reference signal generating device 8.

Figure 2:
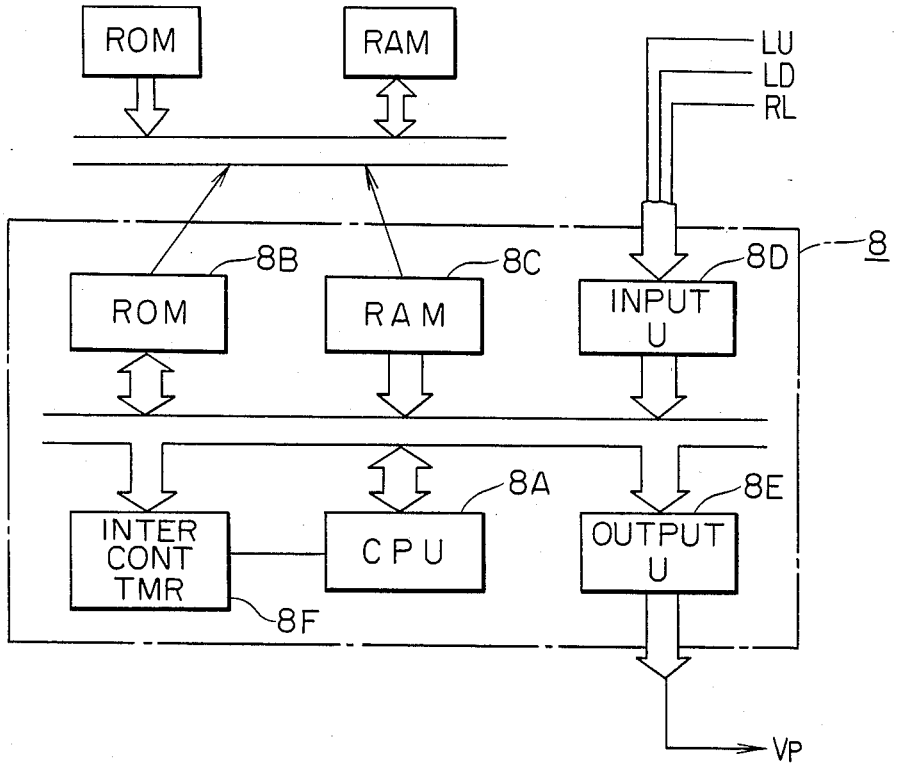
FIG. 2 is a block diagram showing the internal circuit of a speed reference signal generating device in FIG. 1.

FIG. 2 shows the details of the internal circuit of the speed reference signal generating device 8. This internal circuit is composed of a central processing unit (hereinbelow, termed 'CPU') 8A; a ROM 8B in which the processing steps of the programs to be executed by the CPU 8A, etc. are stored; a RAM 8C which stores data such as the operated results of the CPU 8A; an input unit 8D which serves to feed the CPU 8A with the output signals LU, LD and RL of the position detectors 10*a*–10*c*, as well as an output unit 8E which serves to transmit the speed reference signal $V_P$ determined by the CPU 8A; and an interrupt control timer 8F.

Figure 3:
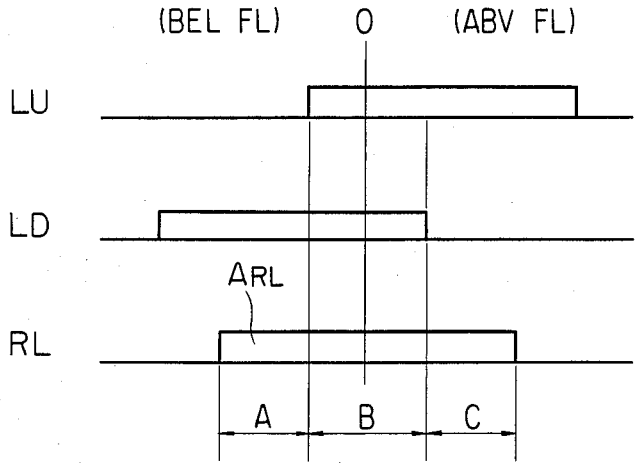
FIG. 3 is a diagram for explaining the operations of position detectors in this invention.

FIG. 3 is a diagram showing the operating extents of the output signals LU, LD and RL of the position detectors 10*a*–10*c* as a cage is operated relative to the landing zone of a floor. A represents an up direction floor re-leveling of the landing zone, section B a normal floor arrival section of the landing zone, and C represents a down direction floor re-leveling section of the landing zone. A point O indicates the actual level of the floor. $A_{RL}$ represents a landing zone in which floor re-leveling is possible, and during which floor re-leveling is performed for sake of safety.

Figure 4:
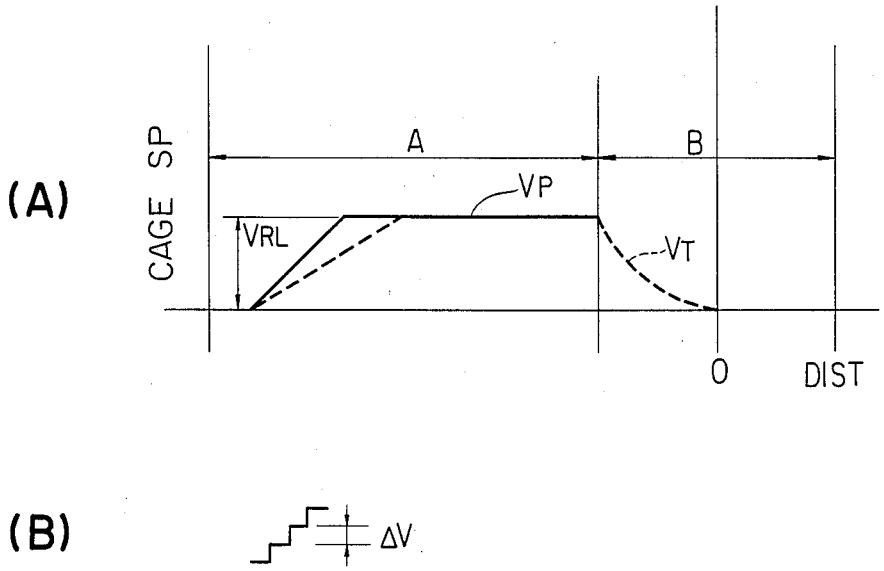
FIGS. 4(A) and 4(B) are characteristic diagrams showing the relationship between the cage speed and the distance near a building floor in this invention.

FIG. 4(A) shows the pattern of the speed reference signal $V_P$ for floor re-leveling. At the time of start, the cage speed is raised with a fixed gradient speed in order to enhance the riding confort. When the cage speed has reached a predetermined speed $V_{RL}$, this speed value is held. When the cage speed has entered the section B, it is lowered to zero. $V_T$ denotes the cage speed at this time. The raising gradient speed at the start changes stepwise with magnitudes of $\Delta V$ as illustrated in FIG. 4(B).

Next, the operation of the floor re-leveling apparatus of this invention constructed as described above will be explained with reference to flow charts shown in FIGS. 5 thru 8. Programs shown in these flow charts are stored in the ROM 8B, and are executed by the CPU 8A in succession.

Figure 5:
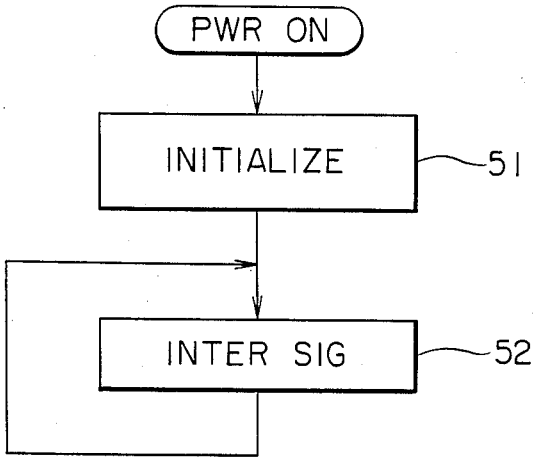
FIG. 5 is a flow chart showing the steps of the initializing and interrupt waiting processes of the speed reference signal generating device in this invention.

Upon closure of a power source, a step 51 indicated in FIG. 5 initializes the speed reference signal generating device 8. Then, the interrupt control timer 8F is started, and a step 52 for awaiting an interrupt is executed.

Figure 6:
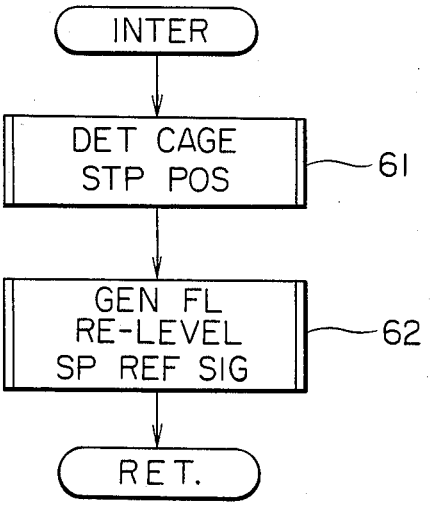
FIG. 6 is a flow chart showing process steps after an interrupt.

When an interrupt signal is output from the timer 8F to the CPU 8A, procedures shown in FIG. 6 are carried out. More specifically, the procedure 61 is a process routine for detecting the stop position of the cage 31. When it is recognized by this procedure that the floor re-leveling is necessary, a process routine for calculating the floor re-leveling speed reference signal $V_P$ as indicated in the next procedure 62 operates.

Figure 7:
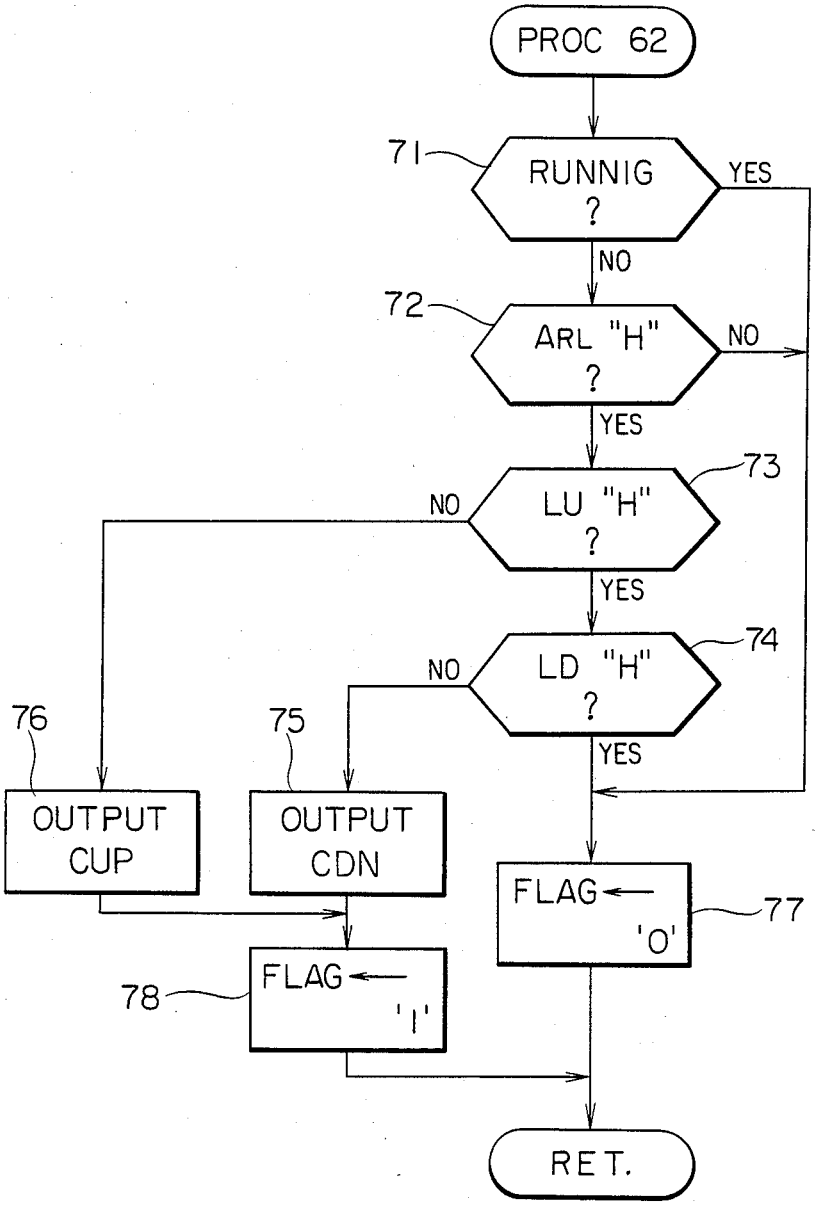
FIG. 7 is a flow chart showing the steps of a cage stop position-detecting process in FIG. 6.

FIG. 7 shows the concrete flow chart of the process routine indicated by the procedure 61. First, at a step 71, whether or not the cage 1 is running is decided. When the cage is running, the flow shifts to a step 77 which executes a process of FLAG←O.

On the other hand, when the decided result of the step 71 is 'NO', that is, when the cage 1 is at a stop, a step 72 decides whether or not the output signal RL of the position detector 10c is "H" (high level) in the section A, that is, $A_{RL}$ is "H". When the result of the decision is 'NO' ($A_{RL}$ is "L" (low level)), it is decided that cage does not lie in the section in which the floor re-leveling is possible, and the flow shifts to the step 77. In a case where $A_{RL}$ is decided to be "H", the flow shifts to a step 73, which decides if the output signal LU of the position detector 10a is "H". When the result of this decision is 'YES', the flow shifts to the next step 74, which decides if the output signal LD of the position detector 10b is "H".

That is, the steps 73 and 74 check the statuses of the output signals LU and LD to decide in which of the sections A, B and C of the landing zone the cage 1 remains stopped. When the cage is at rest in the section A, an up run command CUP is output to the speed control device 6 through the output unit 8E at a step 75, and when the cage is at rest in the section C, a down run command CDN is similarly output at a step 76. When the cage is at rest in the section B, the floor re-leveling is not necessary, and hence, the flow shifts to the step 77, at which the flag FLAG for controlling whether or not the floor re-leveling speed reference signal $V_P$ is calculated is set to "0". A step 78 sets a flag for executing the process routine of the procedure 62, to "1".

Figure 8:
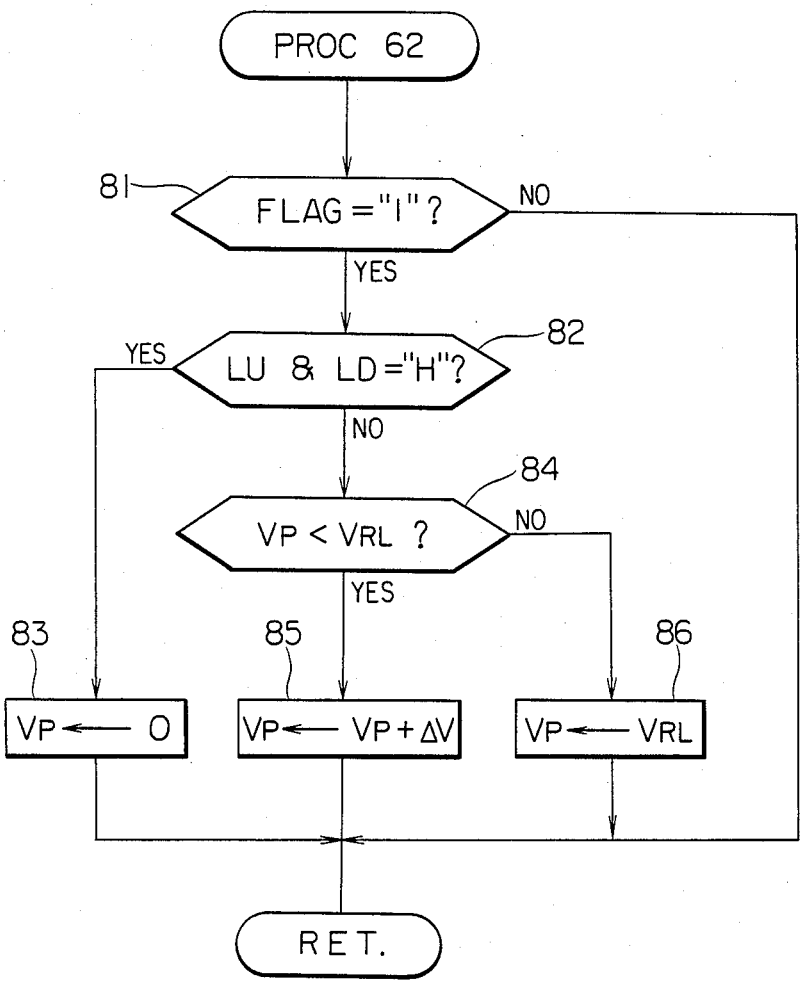
FIG. 8 is a flow chart showing the steps of a process for generating a floor re-leveling speed reference signal in FIG. 6.

FIG. 8 shows the concrete flow of the process routine indicated by the procedure 62. First, if FLAG ="1" holds is judged by a step 81. When FLAG ="1" has been decided, operations at a step 82 et seq. are executed. More specifically, the step 82 decides if both the output signals LU and LD of the respective position detectors 10a and 10b are "H". When the result of this decision is 'YES', the flow shifts to a step 83, which sets the speed reference signal $V_P$ to "0". In contrast, when the result is "NO", the flow shifts to a step 84, which compares $V_P$ and $V_{RL}$. Subject to $V_P<V_{RL}$, the next step 85 performs a process of setting the speed reference signal $V_P$ to $V_P+\Delta V$. On the other hand, subject to $V_P \geqq V_{RL}$, the flow shifts to a step 86, at which the speed reference signal $V_P$ is set to $V_{RL}$.

Owing to the speed reference signal $V_P$ calculated as described above, the cage has its floor precisely re-leveled to the normal floor arrival section B.

Figure 9:
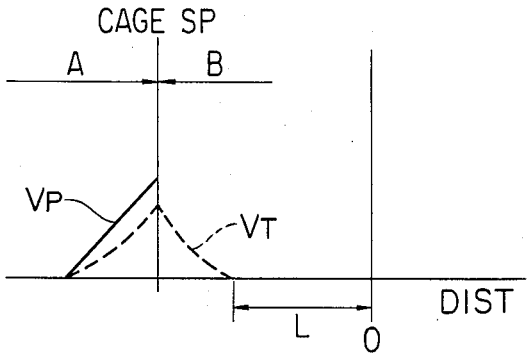
Figure 10:
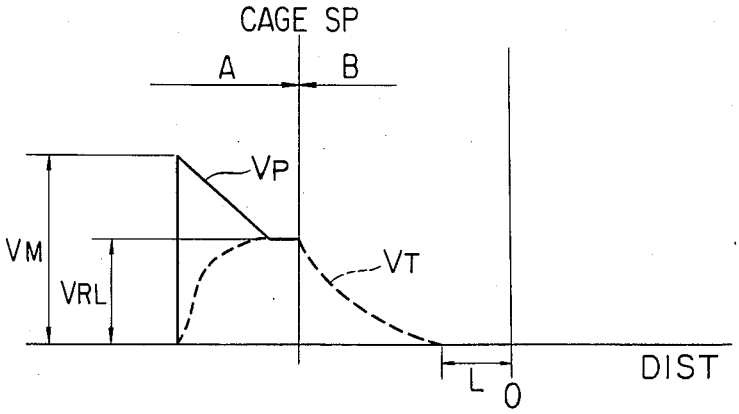
FIG. 10 is a characteristic diagram showing the relationship between the cage speed and the distance according to the system of this invention.
Figure 11:
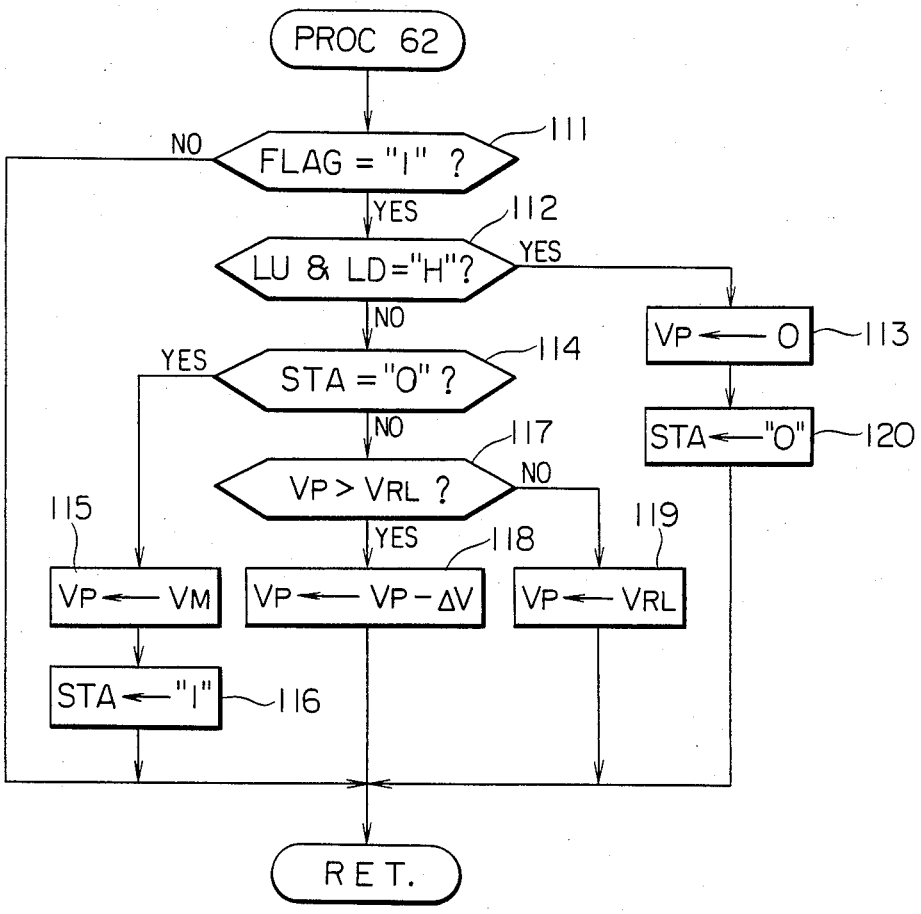
FIG. 11 is a flow chart showing the steps of a process for performing the control of characteristics shown in FIG. 10.
Figure 12:
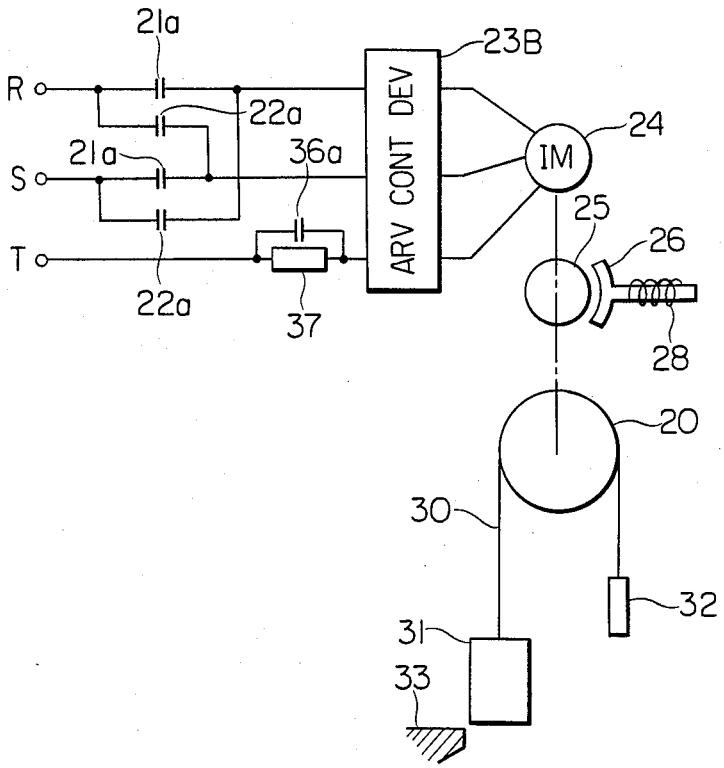
FIG. 12 PRIOR ART
FIG. 12 is a constructional diagram generally showing a prior-art floor re-leveling apparatus for an elevator.
Figure 14:
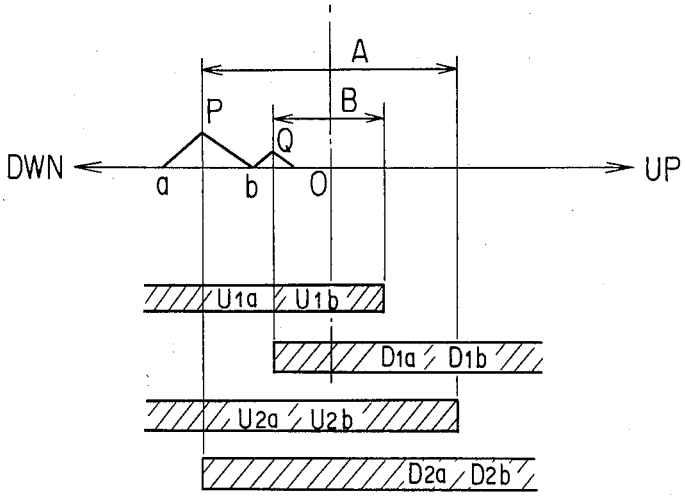
FIG. 14 PRIOR ART
FIG. 14 is a diagram for explaining the operations of position switches in the prior art.
Figure 13:
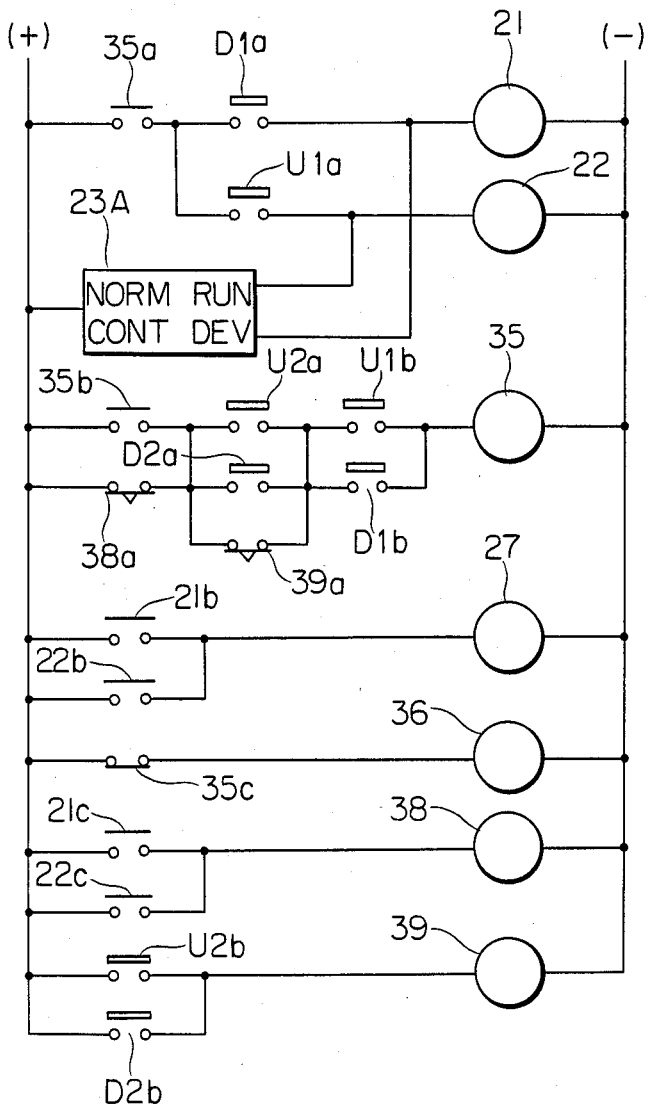
FIG. 13 PRIOR ART
FIG. 13 is a circuit diagram of the floor re-leveling control portion thereof.

FIGS. 9 thru 11 illustrate another embodiment of this invention.

FIG. 9 shows the patterns of a speed reference signal $V_P$ at the time at which the cage is at a stop in the vicinity of the normal section B, and the cage speed $V_T$ at the time at which the cage enters the section B. As apparent from the drawing, the cage enters the section B before $V_P$ reaches $V_{RL}$, and hence, $V_P$ is immediately lowered to zero. Thus, the floor re-leveling operation is completed. However, a deviation L from the level of the building floor is greater than in the case of FIG. 4(A).

FIG. 10 shows the pattern of the speed reference signal $V_P$ for improving the above problem. At the time of start, the cage speed is raised to a predetermined value $V_M$ and is lowered to the value $V_{RL}$ at a fixed gradient. With this measure, as seen from FIG. 10, $V_P$ rises earlier than in FIG. 9, and the speed becomes higher, so that the deviation L from the level of the building floor can be lessened.

FIG. 11 shows a flow which illustrates the processing steps of the floor re-leveling operation described above. As in the case of FIG. 8, a step 111 decides if the flag is "1". Subject to FLAG="1", the next step 112 decides if both the output signals LU and LD of the respective position detectors 10a and 10b are "H". When the result of the decision at the step 112 is 'YES', the flow shifts to a step 113, which sets $VP$ to zero. When the decided result is "NO", the flow shifts to a step 114, which decides whether or not the status of a flag STA is "0". Subject to STA="0", a step 115 performs a process of $V_P \leftarrow V_M$, whereupon the next step 116 sets the flag STA to "1".

On the other hand, when the step 114 has decided that STA="0" does not hold, namely, that STA="1" holds, $V_P$ and $V_{RL}$ are compared at a step 117. If $V_P>V_{RL}$ holds at this time, the next step 118 executes a process of $V_P \leftarrow V_P-\Delta V$, and if $V_P \leqq V_{RL}$ holds, the next step 119 executes a process of $V_P \leftarrow V_{RL}$ A step 120 resets the flag STA to "0" in order to prepare for the next floor re-leveling operation.

Owing to $V_P$ calculated as described above, even when the floor of the cage is re-leveled from the vicinity of the section B, the deviation L from the building floor level can be lessened.

It has been confirmed that, as compared with the signal $V_P$ shown in FIG. 4(A), the signal $V_P$ shown in FIG. 10 does not especially worsen the riding confort at the time of start. In addition, the value $V_M$ in this case should suitably be 2 to 3 times greater than the value $V_{RL}$.

As thus far described, this invention consists in a system which performs by means of a microprocessor the process of detecting a cage stop position as to which of an up direction floor re-leveling operation (section A), a down direction floor re-leveling operation (section C) and a normal floor arrival operation (section B) a cage is at a stop in for each floor, and the process of generating a speed reference signal for floor re-leveling when the floor of the cage lies in the section A or C. Therefore, a floor re-leveling apparatus can be constructed inexpensively. Moreover, the floor arrival driving performance can be enhanced in such a way that the speed reference signal is forced to rise so as to abruptly raise the cage speed.

What is claimed is:

1. A floor re-leveling apparatus for automatically repositioning an elevator cage to position the cage floor at the same level as the hall floor when the elevator cage has arrived at a position where the cage floor level deviates from the hall floor level, said apparatus comprising:

(a) position detecting means to detect the position of the cage to determine whether the cage floor level is within one of three sections of a landing zone in which the cage can be releveled and to produce output signals representative of the level of the cage floor in any one of the three sections, the three sections including a normal floor arrival section containing the building floor level and another section immediately above and another section immediately below the normal floor arrival section;

(b) re-leveling speed reference signalgenerating device receiving the output signals of said position detection means and generating a re-leveling speed reference signal reponsive to an output signal indicating the cage floor is within one of the other sections, which speed reference signal increases at first and terminates responsive to an output signal indicating that the cage floor lies within the normal floor arrival section; and (c) a control device supplied with the speed reference signal from said generating device including means for comparing the speed reference signal with a signal representing actual cage speed and driving the cage responsive to the difference therebetween to reposition the cage and the cage floor into the normal floor arrival section.

2. In a floor re-leveling apparatus for an elevator cage wherein, when an elevator cage has stopped with the cage floor outside a normal floor arrival section of a landing zone at a hall floor, it is automatically releveled to stop it with the cage floor within the normal floor arrival section;

(a) position detection means to detect and provide an output signal indicating whether the cage lies with the cage floor level within the normal floor arrival section and to detect and provide an output signal indicating that the cage lies outside the normal floor arrival section and in another section of the landing zone in which the floor of the cage can be releveled to the level of the hall floor;

(b) a releveling speed reference signal-generating means, which is supplied with an output signal of said position detection means, for generating a releveling speed reference signal having a higher value at first, subsequently decreasing gradually and held fixed after reaching a predetermined value, when it receives an output signal indicating that the cage lies with the cage floor outside the normal floor arrival section and in the other section in which the cage can be re-leveled, and for stopping the generation of the speed reference signal when it received an output signal indicating that the cage lies with the cage floor within the normal floor arrival section; and (c) a control means, which is supplied with the speed reference signal of said speed reference signal generating means including means for comparing the speed reference signal with a signal representing actual cage speed, and for moving and controlling the cage and cage floor into the normal floor arrival section on the basis of the comparison.

3. A floor re-leveling apparatus according to claim 1 wherein said re-leveling speed reference signal-generating device produces a reference signal increasing gradually at first and held fixed after reaching a predetermined value and terminating upon receiving an output signal indicating the cage floor is within the normal floor arrival section.

* * * * *